US008932414B2

(12) United States Patent
Hata et al.

(10) Patent No.: US 8,932,414 B2
(45) Date of Patent: Jan. 13, 2015

(54) HIGH-STRENGTH STEEL SHEET WITH EXCELLENT WARM WORKABILITY

(75) Inventors: Hideo Hata, Kobe (JP); Toshio Murakami, Kobe (JP); Yukihiro Utsumi, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 225 days.

(21) Appl. No.: 13/634,614

(22) PCT Filed: Mar. 22, 2011

(86) PCT No.: PCT/JP2011/056866

§ 371 (c)(1),
(2), (4) Date: Sep. 13, 2012

(87) PCT Pub. No.: WO2011/118597

PCT Pub. Date: Sep. 29, 2011

(65) Prior Publication Data

US 2013/0022490 A1 Jan. 24, 2013

(30) Foreign Application Priority Data

Mar. 24, 2010 (JP) ..... 2010-068477
Feb. 3, 2011 (JP) ..... 2011-021596

(51) Int. Cl.
*C22C 38/02* (2006.01)
*C22C 38/04* (2006.01)
(Continued)

(52) U.S. Cl.
CPC ..... *C21D 8/0226* (2013.01); *C22C 38/02* (2013.01); *C22C 38/04* (2013.01); *C22C 38/06* (2013.01);
(Continued)

(58) Field of Classification Search
None
See application file for complete search history.

(56) References Cited

U.S. PATENT DOCUMENTS 7,468,109 B2 12/2008 Kashima
7,591,977 B2 9/2009 Ikeda et al.
(Continued)

FOREIGN PATENT DOCUMENTS

CN 101082100 A 12/2007
CN 101155939 A 4/2008
(Continued)

OTHER PUBLICATIONS

Machine-English translation of Japanese patent No. 2008-007854, Kashima Takahiro et al, Jan. 17, 2008.*
(Continued)

*Primary Examiner* — Deborah Yee
(74) *Attorney, Agent, or Firm* — Oblon, Spivak, McClelland, Maier & Neustadt, L.L.P.

(57) ABSTRACT

Disclosed is a high-strength steel plate with excellent warm workability that has a component composition comprising, in mass %, 0.05 to 0.4% C, 0.5 to 3% Si+Al, 0.5 to 3% Mn, no more than 0.15% P (not including 0%), and no more than 0.02% S (including 0%), with the remainder comprising iron and impurities, and a composition that includes a total of 45 to 80% martensite and/or bainitic ferrite in terms of the area ratio relative to the entire composition, 5 to 40% polygonal ferrite in terms of the area ratio relative to the entire composition, and 5 to 20% retained austenite in terms of the area ratio relative to the entire composition, wherein the C concentration ($C_{\gamma R}$) within said residual austenite is in the range of 0.6 mass % to less than 1.0 mass %, and that furthermore may include bainite. In the high-strength steel plate, TRIP effects are achieved to the fullest extent in warm working, and increased ductility over prior steel plates is reliably achieved.

15 Claims, 1 Drawing Sheet

(51) Int. Cl.

| | |
|---|---|
| ***C22C 38/06*** | (2006.01) |
| ***C21D 8/02*** | (2006.01) |
| ***C22C 38/12*** | (2006.01) |
| ***C22C 38/14*** | (2006.01) |
| ***C22C 38/16*** | (2006.01) |
| ***C21D 8/04*** | (2006.01) |
| ***C21D 1/20*** | (2006.01) |

(52) U.S. Cl.

CPC ..... *C22C 38/12* (2013.01); *C22C 38/14* (2013.01); *C22C 38/16* (2013.01); *C21D 8/0447* (2013.01); *C21D 8/0463* (2013.01); *C21D 8/0473* (2013.01); *C21D 1/20* (2013.01); *C21D 2211/001* (2013.01); *C21D 2211/002* (2013.01); *C21D 2211/005* (2013.01); *C21D 2211/008* (2013.01)

USPC ..... 148/320; 148/331; 148/333; 148/334; 148/335; 148/336

(56) References Cited

U.S. PATENT DOCUMENTS

| | | | |
|---|---|---|---|
| 7,767,036 | B2 | 8/2010 | Kashima et al. |
| 7,887,648 | B2 | 2/2011 | Kinugasa et al. |
| 8,197,617 | B2 | 6/2012 | Nakaya et al. |
| 2005/0150580 | A1 | 7/2005 | Akamizu et al. |
| 2008/0251160 | A1 | 10/2008 | Akamizu et al. |
| 2009/0053096 | A1 | 2/2009 | Miura et al. |
| 2009/0242085 | A1 | 10/2009 | Ikeda et al. |
| 2009/0277547 | A1 | 11/2009 | Saito et al. |
| 2010/0080728 | A1 | 4/2010 | Ikeda et al. |
| 2010/0092332 | A1 | 4/2010 | Ikeda et al. |
| 2010/0221138 | A1 | 9/2010 | Nakaya et al. |
| 2010/0252147 | A1 | 10/2010 | Murakami et al. |
| 2011/0005643 | A1 | 1/2011 | Murakami et al. |
| 2011/0162762 | A1 * | 7/2011 | Matsuda et al. ..... 148/533 |
| 2012/0009434 | A1 | 1/2012 | Hata et al. |
| 2012/0012231 | A1 | 1/2012 | Murakami et al. |

FOREIGN PATENT DOCUMENTS

| | | |
|---|---|---|
| JP | 60 43425 | 3/1985 |
| JP | 2005-220440 | 8/2005 |
| JP | 2006 274418 | 10/2006 |
| JP | 2008 007854 | 1/2008 |
| JP | 4068950 | 1/2008 |
| WO | WO 2010/030021 A1 * | 3/2010 |

OTHER PUBLICATIONS

Sugimoto, K., et al., "Warm Formability of Ultra High Strength Low Allowy TRIP-aided Sheet Steels with Bainitic Ferrite Matrix," Iron and Steel, vol. 91, No. 2, pp. 278 to 284, (2005) (with English abstract).

Nagasaka, A., et al., "Improvement of Stretch-Flangeability by Transformation Induced Plasticity of Retained Austenite in High-Strength Sheet Steels," Materials and Processes, CAMP-ISIJ, pp. 556 to 559, vol. 8, (1995) (with partial English translation).

Sugimoto, K., et al., "Warm Stretch-Formability of TRIP-Aided Dual-Phase Steels (Effect of second-phase morphology-2)," Materials and Processes, CAMP-ISIJ, vol. 7, p. 518, (1994) (with partial English translation).

Sugimoto, K., et al., "Formability of High-Strength TRIP-Aided Bainitic Cooled Sheet Steels," Materials and Processes, CAMP-ISIJ, vol. 11, No. 4, pp. 400 to 403, (1998) (with partial English translation).

International Search Report Issued Jun. 28, 2011 in PCT/JP11/056866 Filed Mar. 22, 2011.

Office Action issued Aug. 5, 2013 in Chinese Patent Application No. 201180007970.9 (with English translation).

* cited by examiner

HIGH-STRENGTH STEEL SHEET WITH EXCELLENT WARM WORKABILITY

TECHNICAL FIELD

The present invention relates to high-strength TRIP (transformation induced plasticity, strain-induced transformation)-aided steel sheets with excellent warm workability. Specifically, the present invention relates to high-strength steel sheets which are TRIP-aided steel sheets (TRIP-aided steel sheets) having significantly improved elongation as a result of warm working even having ultrahigh strengths on the order of 840 to 1380 MPa.

BACKGROUND ART

Steel sheets to be stamped (press-formed) and used typically in automobiles and industrial machines require both satisfactory strengths and excellent ductility. High-strength, high-ductility steel sheets have been developed so as to ensure collision safety and weight reduction of automobiles, while satisfying the aforementioned requirements. A TRIP-aided steel sheet is listed as one of them. The TRIP-aided steel sheet includes retained austenite (γR) formed in the structure and effectively utilizes such a property that the γR undergoes induced transformation (strain induced transformation: TRIP) during work deformation to help the steel sheet to have better ductility (see, for example, PTL 1).

The TRIP-aided steel sheet is, however, disadvantageously inferior in workability [particularly in stretch flangeability (bore expandability)] so as to allow easy working into a complicated shape. The stretch flangeability is a property necessary for steel sheets for use typically as undercarriage parts of automobiles. Thus, a strong demand has been made to improve stretch flangeability in a TRIP-aided steel sheet also in order to promote the application of the TIP steel sheet typically to undercarriage parts where the weight reduction effect by the TRIP-aided steel sheet is most expected.

Under these circumstances, the present applicants made various investigations so as to provide a steel sheet which maintains excellent strength-ductility balance by the action of γR and excels also in formability such as stretch flangeability. The investigations were made while focusing attention on effects of warm working to improve the stretch flangeability (see, for example, NPL 1 to 3). As a result, they found that a steel sheet, when being suitably controlled in average hardness of the matrix structure, carbon concentration in γR as a second phase, and volume fraction of γR and being subjected to warm working, can give a high-strength steel sheet having both better stretch flangeability and better elongation. An invention was made based on these findings (hereinafter referred to as "prior invention," and a high-strength steel sheet according to the prior invention is referred to as a "steel sheet of the prior invention"), and a patent application was already filed on this invention (see PTL 2).

The steel sheet of the prior invention is a high-strength steel sheet containing, on the percent by mass basis:

carbon (C) in a content of from 0.05% to 0.6%, silicon (Si) and aluminum (Al) in a total content of from 0.5% to 3%, manganese (Mn) in a content of from 0.5% to 3%, phosphorus (P) in a content of 0.15% or less (excluding 0%), and sulfur (S) in a content of 0.02% or less (including 0%), in which the steel sheet has a matrix structure containing 70 percent by area or more of bainitic ferrite and/or granular bainitic ferrite relative to the total structure, the bainitic ferrite and/or granular bainitic ferrite having an average hardness in terms of Vickers hardness of 240 Hv or more, the steel sheet has a second phase structure containing 5 to 30 percent by area of retained austenite relative to the total structure, and the retained austenite has a carbon concentration ($C_{\gamma R}$) of 1.0 percent by mass or more, and the steel sheet may further contain bainite and/or martensite.

PTL 2 mentions that the steel sheet of the prior art has good properties probably because γR itself exhibits maximum plastic stability particularly in a temperature range of from 100° C. to 400° C. (preferably from 150° C. to 250° C.); and that this is achieved by controlling the structure as above and thereby suitably controlling the $C_{\gamma R}$ (carbon concentration in γR) and the hardness of the matrix structure, where $C_{\gamma R}$ significantly affects the TRIP effect due to strain induced transformation of γR, and the hardness of the matrix structure significantly affects the space constraint state of γR (see Paragraph [0023] in PTL 2).

Particularly PTL 2 mentions that, from the viewpoint of exhibiting a TRIP (strain induced transformation working) effect, the steel sheet of the prior invention should essentially have a carbon concentration in γR ($C_{\gamma R}$) of 1.0 percent by mass or more; and that the larger $C_{\gamma R}$ is, the better (see Paragraph [0030] in PTL 2).

However, after further investigations, the present inventors have found that the TRIP effect is maximally exhibited in warm working (100° C. to 250° C.) where the driving force of the stress-induced transformation upon deformation becomes small by controlling the $C_{\gamma R}$ to a lower range of less than 1.0 percent by mass, which is lower than the specific range (1.0 percent by mass or more) in the prior invention; and that a steel sheet having further better ductility than that of the steel sheet of the prior invention, though slightly sacrificing stretch flangeability, can be obtained by further introducing a specific amount of polygonal ferrite.

CITATION LIST

Patent Literature

PTL 1: Japanese Unexamined Patent Application Publication (JP-A) No. S60-43425

PTL 2: Japanese Patent (JP-B) No. 4068950

Non Patent Literature

NPL 1: Akihiko NAGASAKA, Koh-ichi SUGIMOTO, and Mitsuyuki KOBAYASHI, "Improvement of Stretch-Flangeability by Transformation Induced Plasticity of Retained Austenite in High-strength Sheet Steels," Materials and Processes (The Iron and Steel Institute of Japan, Collected Papers), CAMP-ISIJ "Discussion 35", Vol. 8 (1995), pp. 556-559

NPL 2: Koh-ichi SUGIMOTO, Tsuyoshi KONDO, Mitsuyuki KOBAYASHI, and Shun-ichi HASHIMOTO, "Warm Stretch-Formability of TRIP-Aided Dual-Phase Steels (Effect of second-phase morphology-2)," Materials and Processes (The Iron and Steel Institute of Japan, Collected Papers), CAMP-ISIJ "Discussion 518," Vol. 7 (1994), p. 754

NPL 3: Koh-ichi SUGIMOTO & Tetsuo TOYODA, "Formability of High-Strength TRIP-Aided Bainitic Cooled Sheet Steels," Materials and Processes (The Iron and Steel Institute of Japan, Collected Papers), CAMP-ISIJ, Vol. 11 (1998), No. 4, pp. 400-403

SUMMARY OF INVENTION

Technical Problem

The present invention has been made as focusing attention on these circumstances, and an object thereof is to provide a high-strength steel sheet which exhibits TRIP effects maximally upon warm working and which may have even better ductility than that of the steel sheet of the prior invention.

Solution to Problem

An invention as claimed in claim 1 is a high-strength steel sheet with excellent warm workability. The steel sheet has a chemical composition, on the percent by mass basis (hereinafter the same is applied to contents in the chemical composition), including carbon (C) in a content of from 0.05% to 0.4%;

silicon (Si) and aluminum (Al) [Si+Al] in a total content of from 0.5% to 3%;

manganese (Mn) in a content of from 0.5% to 3%;

phosphorus (P) in a content of 0.15% or less (excluding 0%); and sulfur (S) in a content of 0.02% or less (including 0%), with the remainder including iron and impurities, the steel sheet has a structure including:

martensite and/or bainitic ferrite in a total amount of 45 to 80 percent by area relative to the total structure;

polygonal ferrite in an amount of 5 to 40 percent by area relative to the total structure; and retained austenite in an amount of 5 to 20 percent by area relative to the total structure, in which the structure has a carbon concentration ($C_{\gamma R}$) in the retained austenite of 0.6 percent by mass or more and less than 1.0 percent by mass, and the structure may further include bainite.

An invention as claimed in claim 2 is the high-strength steel sheet with excellent warm workability according to claim 1, in which the chemical composition further includes at least one element selected from the group consisting of:

molybdenum (Mo) in a content of 1% or less (excluding 0%), nickel (Ni) in a content of 0.5% or less (excluding 0%), copper (Cu) in a content of 0.5% or less (excluding 0%), and chromium (Cr) in a content of 1% or less (excluding 0%).

An invention as claimed in claim 3 is the high-strength steel sheet with excellent warm workability according to claim 1 or 2, in which the chemical composition further includes at least one element selected from the group consisting of:

titanium (Ti) in a content of 0.1% or less (excluding 0%), niobium (Nb) in a content of 0.1% or less (excluding 0%), vanadium (V) in a content of 0.1% or less (excluding 0%), and zirconium (Zr) in a content of 0.1% or less (excluding 0%).

An invention as claimed in claim 4 is the high-strength steel sheet with excellent warm workability according to any one of claims 1 to 3, in which the chemical composition further includes:

calcium (Ca) in a content of 0.003% or less (excluding 0%) and/or a rare-earth element (REM) in a content of 0.003% or less (excluding 0%).

Advantageous Effects of Invention

The present invention can provide a high-strength steel sheet having further better ductility than that of the steel sheet of the prior invention. This is because the high-strength steel sheet of the present invention allows warm working to exhibit ductility improving effects maximally by containing martensite and/or bainitic ferrite in a total amount of 45 to 80 percent by area relative to the total structure, containing polygonal ferrite in an amount of 5 to 40 percent by area relative to the total structure, containing retained austenite in an amount of 5 to 20 percent by area relative to the total structure, and having a carbon concentration ($C_{\gamma R}$) in the retained austenite of 0.6 percent by mass or more and less than 1.0 percent by mass.

DESCRIPTION OF EMBODIMENTS

Figure 1:
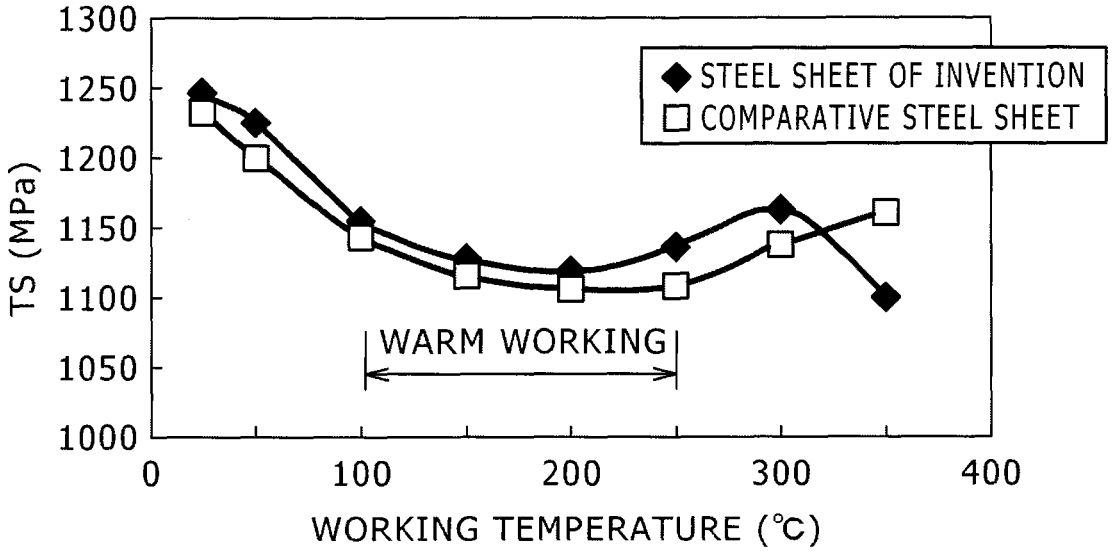
FIG. 1 is a graphical representation illustrating how the working temperature, when varied, affects the tensile strength (TS), in which a steel sheet of the present invention is compared with a comparative steel sheet.

As has been described above, the present inventors have focused attention on TRIP-aided steel sheets which contain bainitic ferrite having a substructure with high dislocation density as in the steel sheet of the prior invention (however, bainitic ferrite and/or granular bainitic ferrite in PTL 2) and retained austenite (γR) and made further investigations to further improve ductility through warm working. As a result, the present inventors have found that the TRIP action can be maximally exhibited in warm working by allowing a steel sheet to have a lower carbon concentration in γR ($C_{\gamma R}$) in the range of 0.6 percent by mass or more and less than 1.0 percent by mass, which is lower than the range specified in the prior invention (1.0 percent by mass or more) and by allowing the steel sheet to contain polygonal ferrite (hereinafter also simply referred to as "ferrite") in a specific amount; and that the resulting steel sheet is a high-strength steel sheet having further better ductility, although slightly sacrificing the stretch flangeability (λ), as compared to the steel sheet of the prior invention. In this connection, the steel sheet of the present invention has a stretch flangeability (λ) of from about 10% to about 20%, which is slightly lower than that of the steel sheet of the prior invention (about 30%)). The present invention has been made based on these findings.

Initially, the structure featuring the steel sheet of the present invention will be illustrated below.

[Structure of Steel Sheet of the Present Invention]

As has been described above, the steel sheet of the present invention is based on a structure of a TRIP-aided steel as with the steel sheet of the prior invention. However, the steel sheet of the present invention differs from the steel sheet of the prior invention in that the former contains polygonal ferrite in a specific amount and is controlled to have a carbon concentration in retained austenite ($C_{\gamma R}$) of 0.6 percent by mass or more and less than 1.0 percent by mass; but the latter does not contain polygonal ferrite and is controlled to have a $C_{\gamma R}$ of 1.0 percent by mass or more.

<Containing Martensite and/or Bainitic Ferrite in a Total Amount of 45 to 80 Percent by Area Relative to the Total Structure>

As used herein the "bainitic ferrite" corresponds to a bainite structure having, as a substructure, a lath-shaped structure with a high dislocation density, but, as containing no carbide therein, distinctly differs from the bainite structure; and also differs from polygonal ferrite structures having a substructure with no or very little dislocation density and also from quasi-polygonal ferrite structures having a substructure typically of fine sub-grains (see "Atlas for Bainitic Microstructures Vol. 1" issued by the Basic Research Group of the Iron and Steel Institute of Japan). This structure is observed as being acicular and is hardly distinguishable from bainite structures and polygonal ferrite structures in observation with an optical microscope or with a scanning electron microscope (SEM). Determination of distinct difference typically from the bainite structures and polygonal ferrite structures requires identification of substructures by observation with a transmission election microscope (TEM).

Thus, the steel sheet of the present invention has a structure including martensite and/or bainitic ferrite as a principal structure, which martensite and/or bainitic ferrite bounds and constrains γR and thereby helps the ductility improving action to be exhibited effectively through the strain induced transformation effect of γR.

The steel sheet of the present invention should contain the martensite and/or bainitic ferrite structure in a total amount of 45 to 80 percent by area (preferably 50 to 80 percent by area, and more preferably 53 to 60 percent by area) relative to the total structure. This allows the martensite and/or bainitic ferrite structure to exhibit the effects effectively. The amount of the martensite and/or bainitic ferrite structure may be decided based on the balance with γR, and it is recommended to control the amount appropriately so as to allow the steel sheet to exhibit desired properties.

<Containing Polygonal Ferrite in an Amount of 5 to 40 Percent by Area Relative to the Total Structure>

The presence of polygonal ferrite in a specific amount in the structure helps, combined with the TRIP action of γR as mentioned later, the steel sheet to have a further higher total elongation, though slightly sacrificing stretch flangeability. To exhibit the action effectively, polygonal ferrite should be present in an amount of 5 percent by area or more (preferably 10 percent by area or more, and more preferably 20 percent by area or more) relative to the total structure. In contrast, polygonal ferrite, if present in an excessively large amount, may significantly adversely affect the stretch flangeability, and, to avoid this, the upper limit is set to be 40 percent by area.

<Containing Retained Austenite (γR) in an Amount of 5 to 20 Percent by Area Relative to the Total Structure>

Retained austenite (γR) is useful for improvements in total elongation. To exhibit this action effectively, retained austenite should be present in an amount of 5 percent by area or more (preferably 10 percent by area or more, and more preferably 15 percent by area or more) relative to the total structure. In contrast, retained austenite, if present in an excessively large amount, may significantly adversely affect the stretch flangeability, and, to avoid this, the upper limit is set to be 20 percent by area.

<Having Carbon Concentration ($C_{\gamma R}$) in Retained Austenite (γR) of 0.6 Percent by Mass or More and Less than 1.0 Percent by Mass>

In addition, the steel sheet has a carbon concentration in γR ($C_{\gamma R}$) of 0.6 percent by mass or more and less than 1.0 percent by mass. As has been described above, the $C_{\gamma R}$ significantly affects properties of TRIP (strain induced transformation working). According to customary techniques as in the steel sheet of the prior invention, $C_{\gamma R}$ should essentially be 1.0 percent by mass or more, and it is believed that the more the $C_{\gamma R}$ is, the better. The steel sheet of the present invention, however, has a $C_{\gamma R}$ in the range of 0.6 percent by mass or more and less than 1.0 percent by mass, which range is lower than that in the steel sheet of the prior invention. This allows the steel sheet of the present invention to exhibit the TRIP effect and to have further better ductility in warm working (at temperatures from 100° C. to 250° C.) where the driving force of the stress-induced transformation upon deformation becomes small. The steel sheet of the present invention has a $C_{\gamma R}$ of preferably 0.7 percent by mass or more and 0.9 percent by mass or less.

<Others: Bainite (Including 0%)>

The steel sheet of the present invention may include the aforementioned structure alone (mixed structure of martensite and/or bainitic ferrite, polygonal ferrite, and γR), but may further include bainite as another dissimilar structure within a range not adversely affecting the operation of the present invention. The bainite structure can inevitably remain during the manufacture process of the steel sheet of the present invention, but the less the bainite structure is, the better. It is therefore recommended to control bainite to be present in an amount of 5 percent by area or less, and more preferably 3 percent by area or less relative to the total structure.

[Measurement Methods of Area Percentages of Respective Phases and Carbon Concentration in γR ($C_{\gamma R}$)]

Measurement methods of area percentages of respective phases and carbon concentration in γR ($C_{\gamma R}$) will be described below.

The area percentages of respective structures in the steel sheet were measured by subjecting the steel sheet to LePera etching, identifying structures through observation with a transmission electron microscope (TEM; at a 1500-fold magnification), and measuring the area percentages of the structures through observation with an optical microscope (at a 1000-fold magnification). The area percentage of γR and the carbon concentration in γR ($C_{\gamma R}$) were measured by grinding the steel sheet to a depth of one-fourth the thickness thereof, subjecting the ground steel sheet to chemical polishing, and measuring through X-ray diffractometry (ISIJ Int. Vol. 33 (1933), No. 7, p. 776).

Next, the chemical composition (composition of components) constituting the steel sheet of the present invention will be described. Hereinafter all chemical compositions are indicated on the percent by mass basis.

[Chemical Composition of Steel Sheet of Present Invention]

Carbon (C) Content: 0.05% to 0.4%

Carbon (C) element is essential for obtaining desired principal structures (martensite and/or bainitic ferrite, and γR). To exhibit the action effectively, carbon should be present in a content of 0.05% or more (preferably 0.10% or more, and more preferably 0.15% or more). However, a steel sheet having a carbon content of more than 0.4% may be unsuitable for welding.

Total Content of Silicon (Si) and Aluminum (Al): 0.5% to 3%

Silicon (Si) and aluminum (Al) elements effectively suppress the decompositions of γR into carbides. Among them, Si is also useful as a solid-solution strengthening element. To exhibit these actions effectively, Si and Al should be added in a total content of 0.5% or more. The total content is preferably 0.7% or more, and more preferably 1% or more. However, the elements, if added in a total content of more than 3%, may impede the formation of the martensite and/or bainitic ferrite structure; may often cause the weld bead to be brittle due to excessively high hot deformation resistance; and may adversely affect the surface quality of the steel sheet. To avoid these, the upper limit of the total content is set to be 3%. The total content is preferably 2.5% or less, and more preferably 2% or less. The Si content is desirably 2.0% or less, and the Al content is desirably 1.5% or less. The Si content and the Al content are each more than 0%.

Manganese (Mn) Content: 0.5% to 3.0%

Manganese (Mn) element effectively acts as a solid-solution strengthening element and also exhibits the action of promoting transformation to thereby accelerate the formation of the martensite and/or bainitic ferrite structure. In addition, this element is necessary for stabilizing austenite (γ) to thereby obtain desired γR. To exhibit these actions effectively, Mn should be added in a content of 0.5% or more. The Mn content is preferably 0.7% or more, and more preferably 1% or more. However, Mn, if added in a content of more than 3%, may cause adverse effects such as slab cracking. The Mn content is preferably 2.5% or less, and more preferably 2% or less.

Phosphorus (P) Content: 0.15% or Less (Excluding 0%)

Phosphorus (P) element is effective for ensuring desired γR. To exhibit the action effectively, phosphorus is recommended to be added in a content of 0.03% or more (more preferably 0.05% or more). However, phosphorus, if added in a content of more than 0.15%, may adversely affect secondary workability. The phosphorus content is more preferably 0.1% or less.

Sulfur (S) Content: 0.02% or Less (Including 0%)

Sulfur (S) element forms sulfide inclusions such as MnS, thereby causes cracking, and impairs workability. To avoid these, the sulfur content is set to be 0.02% or less and is preferably 0.015% or less.

The steel for use in the present invention basically contains the chemical components with the remainder being substantially iron and inevitable impurities. The steel, however, may further contain the following permissible components, within ranges not adversely affecting the operation of the present invention.

At least one element selected from the group consisting of:
molybdenum (Mo) in a content of 1% or less (excluding 0%),
nickel (Ni) in a content of 0.5% or less (excluding 0%),
copper (Cu) in a content of 0.5% or less (excluding 0%), and
chromium (Cr) in a content of 1% or less (excluding 0%)

These elements are useful as strengthening elements for the steel and are effective for stabilizing γR and ensuring γR in a specific amount. To exhibit these actions effectively, it is recommended to add Mo in a content of 0.05% or more (more preferably 0.1% or more), Ni in a content of 0.05% or more (more preferably 0.1% or more), Cu in a content of 0.05% or more (more preferably 0.1% or more), and Cr in a content of 0.05% or more (more preferably 0.1% or more), respectively. However, if the Mo and Cr contents each exceed 1%, or if the Ni and Cu contents each exceed 0.5%, the effects are saturated, thus being economically ineffective. More preferably, the Mo content is 0.8% or less, the Ni content is 0.4% or less, the Cu content is 0.4% or less, and the Cr content is 0.8% or less.

At least one element selected from the group consisting of:
titanium (Ti) in a content of 0.1% or less (excluding 0%),
niobium (Nb) in a content of 0.1% or less (excluding 0%),
vanadium (V) in a content of 0.1% or less (excluding 0%), and
zirconium (Zr) in a content of 0.1% or less (excluding 0%)

These elements have effects of precipitation strengthening and of forming a finer structure and are useful to help the steel sheet to have a higher strength. To exhibit these actions effectively, it is recommended to add Ti in a content of 0.01% or more (more preferably 0.02% or more), Nb in a content of 0.01% or more (more preferably 0.02% or more), V in a content of 0.01% or more (more preferably 0.02% or more), and Zr in a content of 0.01% or more (more preferably 0.02% or more), respectively. However, the effects may be saturated if the elements are added each in a content of more than 0.1%, thus being economically inefficient. More preferably, the Ti content is 0.08% or less, the Nb content is 0.08% or less, the V content is 0.08% or less, and the Zr content is 0.08% or less.

Calcium (Ca) in a Content of 0.003% or Less (Excluding 0%) and/or Rare-Earth Element (REM) in a Content of 0.003% or Less (Excluding 0%)

Calcium (Ca) element and REMs (rare-earth elements) control the form of sulfides in the steel and are thereby effective for improving workability. Exemplary rare-earth elements for use in the present invention include Sc, Y, and lanthanoid elements. To exhibit these actions effectively, it is recommended to add Ca and the REM each in a content of 0.0003% or more (more preferably 0.0005% or more). However, the effects may be saturated if these elements are added each in a content of more than 0.003%, thus being economically inefficient. The contents are each more preferably 0.0025% or less.

Next, a preferred method for manufacturing the steel sheet of the present invention will be illustrated below.

[Preferred Method for Manufacturing Steel Sheet of the Present Invention]

Initially, a steel having a chemical composition within the above-specified range is heated to a temperature in the austenite and ferrite (γ+α) dual-phase region and soaked. Specifically, the soaking is performed by heating at a temperature of 750° C. or higher (preferably 780° C. or higher) and lower than 850° C. (preferably 840° C. or lower) for 100 to 1000 seconds (preferably 300 to 600 seconds). After soaking, the steel is cooled (supercooled) at an average cooling rate of 30° C./s or more (preferably 40° C./s or more, more preferably 50° C./s or more, and particularly preferably 70° C./s or more) to a temperature in the range of 150° C. or higher (preferably 200° C. or higher) and 350° C. or lower (preferably 300° C. or lower); held at the supercooling temperature for 60 seconds or shorter (preferably 5 to 50 seconds); reheated at an average heating rate of 2° C./s or more (preferably 10° C./s or more) to a temperature in the range of higher than the supercooling temperature, and 300° C. or higher (preferably 350° C. or higher, and more preferably 400° C. or higher) and 480° C. or lower (preferably 450° C. or lower); held in this temperature range for 60 seconds or longer (preferably 300 seconds or longer) and 1000 seconds or shorter (preferably 600 seconds or shorter) (austempering).

The steel sheet of the prior invention is manufactured through the steps of soaking at a temperature in the austenite-single region, quenching, and austempering performed in this order. Thus, heating is performed at a temperature in the austenite single-phase region, and this impedes the formation of polygonal ferrite. In addition, the austempering is performed immediately after quenching, and thereby the strength increases with a lowering austempering temperature, but $C_{\gamma R}$ also increases. This is because as follows. Initially, with a lowering austempering temperature, the formed bainitic ferrite has a higher hardness and thereby has a higher strength. Independently, the carbon concentration $C_{\gamma R}$ is determined by how much degree carbon is enriched in the austenite side with the formation of bainitic ferrite which contains substantially no carbon as a solid solution. The carbon concentration $C_{\gamma R}$ increases with a lowering austempering temperature, because austenite having a higher carbon concentration becomes stable with a lowering temperature. Accordingly, the steel sheet of the prior invention should be subjected to austempering at a low temperature of 450° C. or lower so as to have a high tensile strength of 840 MPa or more, and thereby necessarily has a $C_{\gamma R}$ of 1 percent by mass or more.

In contrast, the steel sheet of the present invention is manufactured by the sequential steps of soaking at a temperature in the (γ+α) dual-phase region, supercooling, reheating, and austempering performed in this order. The heating in the ($\gamma+\alpha$) dual-phase region as above helps the formation of polygonal ferrite in a desired amount. In addition, the steel is once supercooled to a predetermined temperature range prior to the austempering, and then reheated to an austempering temperature and held at that temperature to perform austempering. Thus, the steel can have a high tensile strength of 840 MPa or more, can include polygonal ferrite having satisfactory ductility, and can have a low $C_{\gamma R}$ of less than 1.0 percent by mass simultaneously. While detailed mechanisms still remain unknown, reasons of this are probably as follows. Specifically, during the cooling process down to a supercooling state and during the reheating process, a structure is initially partially formed, which structure has a dislocation density and hardness higher than those of bainitic ferrite and contains carbon as a supersaturated solid solution, where the bainitic ferrite will be formed upon austempering. The remainder remains as austenite and as polygonal ferrite formed upon heating in the dual-phase region. The partial structure with a high dislocation density is tempered while discharging carbon to the austenite side during austempering, thereby has a decreased dislocation density and becomes a structure similar to that of bainitic ferrite. However, this structure originally had a high dislocation density and, even after the process, maintains a dislocation density higher than that of bainitic ferrite which is formed during austempering. Specifically, the steel surely has a sufficient strength even when austempered at a temperature higher than the temperature in the case where soaking and subsequent austempering are performed without supercooling. The treatments through these steps allow the steel to have both a high strength and a low carbon concentration $C_{\gamma R}$, because $C_{\gamma R}$ decreases with an elevating austempering temperature. Upon austempering, the partial structure with a high dislocation density formed during supercooling changes into a structure similar to bainitic ferrite, i.e., a structure having a lath-shaped substructure and including no carbide therein and is not distinguishable from bainitic ferrite by observation with regular microscopes (optical microscope, SEM, and TEM). For this reason, the both structures are collectively referred to as "bainitic ferrite."

The supercooling, if performed at an excessively low temperature, may allow martensite transformation to proceed, and this may impede discharge of carbon into the austenite during austempering after reheating, and the resulting steel may not contain retained austenite in a necessary amount. In contrast, the supercooling, if performed at an excessively high temperature, may fail to lower the $C_{\gamma R}$, because the difference between the supercooling temperature and the austempering temperature is small. The supercooling, if performed at the supercooling temperature for an excessively long holding time, may fail to give retained austenite in a necessary amount as above, due to proceeding of martensite transformation. The holding time may be short, but is preferably certain duration (5 seconds or longer) from the viewpoint of reproducibility of temperature control in a real operation.

The cooling steps of soaking in the ($\gamma+\alpha$) dual-phase region and subsequent supercooling are important particularly for obtaining the desired principal structure, unlike the steel sheet of the prior invention. By soaking in the ($\alpha+\gamma$) dual-phase region and subsequently quenching in the above manner, the desired martensite and/or bainitic ferrite (principal structure) can be formed while allowing polygonal ferrite to be formed in a predetermined amount. Among conditions, the average cooling rate significantly affects the form of $\gamma$R, is thereby extremely important, and should be controlled within the above-specified range so as to allow $\gamma$R in a predetermined form to be formed between laths of the martensite and/or bainitic ferrite structure. The average cooling rate is not critical in its upper limit, and the higher is, the better. However, the average cooling rate is desirably controlled suitably in consideration of the real operation level.

As is described above, the austempering after supercooling and subsequent reheating is very important for the tempering of the structure which is formed during supercooling and has a high dislocation density, for the formation of bainitic ferrite, for carbon enrichment (concentration) into the austenite phase, and for the suppression of decomposition of retained austenite into carbides, which retained austenite is formed with these. Limitation in holding time in austempering within the range effectively suppresses the decomposition of regained austenite into carbides. Austempering, if performed at an excessively high temperature, may cause retained austenite to be readily decomposed into carbides to thereby fail to remain as retained austenite in a predetermined amount. In contrast, austempering, if performed at an excessively low temperature or if performed for an excessively short holding time, may fail to allow carbon to be concentrated in retained austenite. A portion with a low $C_{\gamma R}$ gives martensite in the cooling process after austempering, but the formation of such martensite is acceptable within a range not adversely affecting the operation of the present invention The bainite structure may further be formed in the step, within a range not adversely affecting the operation of the present invention. Plating (and, if desired, a subsequent alloying treatment) may be performed within a range not adversely affecting the operation of the present invention and not significantly decomposing the desired structure.

The steel sheet of the present invention manufactured by the method, when subjected to warm working, can give a high-strength steel sheet which has further better ductility than that of the steel sheet of the prior invention, although slightly sacrificing the stretch flangeability. As used herein the term "warm working" refers to warm forming at a temperature of from 100° C. to 250° C. (preferably from 120° C. to 200° C., and most preferably around about 150° C.). The steel sheet may be soaked so that the entire steel sheet is in the temperature range. As is demonstrated by the after-mentioned experimental examples, the steel sheet of the present invention, when subjected to warm working, gives a steel sheet which has, as compared to a steel sheet obtained from the steel sheet of the prior invention through warm working, an equivalent tensile strength (TS) at room temperature, an elongation under warm conditions (warm EL) higher by about 40%, and a higher product of the tensile strength (TS) at room temperature and warm elongation (EL under warm conditions) by as much as about 30% to about 40%, thus exhibiting significant improving effects. The product is an index of balance between the tensile strength (TS) at room temperature and the warm elongation (EL) (compare Steel No. 1 with Steel No. 13 or Steel No. 15 in Table 5 below).

The steel sheet of the present invention has high forming limit upon warm working and is thereby advantageously usable even for working into parts having complicated shapes, such as parts constituting center pillars and parts constituting front pillars.

The resulting warm-formed parts obtained through warm working of the steel sheet of the present invention have a high yield stress and a large maximum load upon deformation due to bainitic ferrite contained in a large amount as its structure, and they are expected to exhibit high load bearing properties. They are therefore advantageously usable typically as parts constituting side sills, parts constituting roof rails, and other parts.

The warm-formed parts may probably be resistant to scale generation and have relatively good paint application properties, because the warm working is performed at a temperature not so high as in hot working. They are therefore advantageously usable typically as parts constituting floor cross members, parts constituting roof panels, and other parts.

In addition, the warm-formed parts obtained through warm working of the steel sheet of the present invention, when being allowed to contain retained austenite remained in a suitable amount, can have good elongation properties and a high work hardening factor even after working and are expected to exhibit such properties that they are resistant to rupture even when used as parts and absorb energy in a large quantity. For these reasons, the warm-formed parts may probably be advantageously used even as, for example, parts constituting front side members and parts constituting rear side members.

EXAMPLES

Experimental Example 1

Analysis on Chemical Composition

How the chemical composition, when varied, affects mechanical properties was investigated in this experimental example. Specifically, slab specimens were prepared by vacuum ingot making of steels having the chemical compositions given in Table 1 (resulting hot-roiled sheets had a gage of 2.0 mm), and the slabs were subjected to heat treatments under the manufacture conditions given in Table 2.

The resulting steel sheets were examined by measuring the area percentages of respective phases and the carbon concentration in γR ($C_{\gamma R}$) according to the measurement methods described in [Description of Embodiments] above.

In addition, to determine how the working temperature affects the mechanical properties, the tensile strength (TS), YS [lower yield point (yield stress)], and elongation [i.e., total elongation (EL)] were measured at working temperatures (tensile temperature) varying from 20° C. to 350° C. according to the following procedure.

In a tensile test, TS, YS, and EL were measured using a Japanese Industrial Standards (JIS) No. 5 specimen. The tensile test was performed at a strain rate of 1 mm/s.

The results are indicated in Table 3.

TABLE 1

(in percent by mass)

| Material Steel No. | C | Si | Al | Si + Al | Mn | P | S | Others |
|---|---|---|---|---|---|---|---|---|
| 1 | 0.07 | 1.50 | 0.36 | 1.86 | 2.36 | 0.007 | 0.0010 | Mo: 0.92 |
| 2 | 0.19 | 1.56 | 0.34 | 1.90 | 2.75 | 0.009 | 0.0009 | — |
| 3 | 0.19 | 0.48 | 0.11 | 0.59 | 2.49 | 0.010 | 0.0013 | — |
| 4 | 0.24 | 1.58 | 0.38 | 1.96 | 0.69 | 0.009 | 0.0012 | Mo: 0.55, Ti: 0.04 |
| 5 | 0.18 | 0.75 | 1.12 | 1.87 | 2.37 | 0.007 | 0.0010 | Mo: 0.32 |
| 6 | 0.19 | 1.98 | 0.47 | 1.96 | 2.46 | 0.009 | 0.0012 | Ni: 0.12 |
| 7 | 0.18 | 1.25 | 0.64 | 1.89 | 2.39 | 0.008 | 0.0011 | Cu: 0.43 |
| 8 | 0.19 | 1.11 | 0.88 | 1.99 | 2.49 | 0.010 | 0.0013 | Cr: 0.57 |
| 9 | 0.18 | 0.89 | 1.09 | 1.98 | 2.74 | 0.011 | 0.0010 | Ti: 0.06 |
| 10 | 0.19 | 1.82 | 0.13 | 1.95 | 2.45 | 0.009 | 0.0012 | Nb: 0.04 |
| 11 | 0.21 | 1.75 | 0.23 | 1.98 | 2.48 | 0.010 | 0.0013 | V: 0.07 |
| 12 | 0.18 | 1.55 | 0.33 | 1.88 | 2.38 | 0.008 | 0.0011 | Ca: 0.002 |
| 13 | 0.19 | 1.11 | 0.85 | 1.96 | 2.46 | 0.009 | 0.0012 | REM: 0.002 |
| 14a | 0.01a | 1.56 | 0.30 | 1.86 | 2.36 | 0.007 | 0.0010 | — |
| 15a | 0.18 | 0.23 | 0.13 | 0.36a | 2.38 | 0.008 | 0.0011 | — |
| 16a | 0.18 | 1.75 | 0.13 | 1.88 | 0.34a | 0.008 | 0.0011 | — |
| 17 | 0.18 | 1.49 | 0.38 | 1.87 | 2.52 | 0.009 | 0.0008 | Zr: 0.05 |

(a: out of the range specified in the present invention)

TABLE 2

| Manufacture No. | Soaking temperature (° C.) | Soaking time (s) | Cooling rate (° C.) | Supercooling temperature (° C.) | Supercooling holding time (s) | Reheating rate (° C./s) | Austempering temperature (° C.) | Austempering time (s) |
|---|---|---|---|---|---|---|---|---|
| 1 | 850 | 150 | 50 | 350 | 5 | 20 | 400 | 500 |
| 2 | 780 | 300 | 50 | 350 | 5 | 20 | 400 | 500 |
| 3 | 760 | 600 | 50 | 350 | 5 | 20 | 400 | 500 |
| 4 | 750 | 500 | 50 | 350 | 5 | 20 | 400 | 500 |
| 5 | 780 | 500 | 50 | 350 | 5 | 20 | 400 | 500 |
| 6 | 780 | 500 | 50 | 350 | 5 | 20 | 400 | 500 |
| 7 | 780 | 400 | 50 | 350 | 5 | 20 | 400 | 500 |
| 8 | 780 | 500 | 50 | 350 | 5 | 20 | 400 | 500 |
| 9 | 780 | 500 | 50 | 350 | 5 | 20 | 400 | 500 |
| 10 | 780 | 500 | 50 | 350 | 5 | 20 | 400 | 500 |
| 11 | 780 | 500 | 50 | 350 | 5 | 20 | 400 | 500 |
| 12 | 780 | 500 | 50 | 350 | 5 | 20 | 400 | 500 |
| 13 | 780 | 500 | 50 | 350 | 5 | 20 | 400 | 500 |
| 14b | 900b | 500 | 50 | 350 | 5 | 20 | 400 | 500 |
| 15 | 820 | 500 | 50 | 350 | 5 | 20 | 400 | 500 |
| 16 | 760 | 500 | 50 | 350 | 5 | 20 | 400 | 500 |
| 17 | 780 | 500 | 30 | 350 | 5 | 20 | 400 | 500 |

(b: out of recommended range)

TABLE 3

| Material | | | Structure | | | | Mechanical properties at room temperature | | | Mechanical properties at a temperature (150° C.-300° C.) where EL attains maximum | | | Product of room-temperature TS | |
|---|---|---|---|---|---|---|---|---|---|---|---|---|---|---|
| Steel No. | Steel No. | Manufacture No. | M + BF (%) | PF (%) | $\gamma_R$ (%) | $C\gamma_R$ (mass %) | YS (MPa) | TS (MPa) | EL (%) | YS (MPa) | TS (MPa) | EL (%) | and warm EL (MPa. %) | Judgment |
| 1 | 1 | 1 | 52.9 | 38.2 | 8.9 | 0.88 | 458 | 995 | 14.3 | 471 | 846 | 27.3 | 27164 | ○ |
| 2 | 2 | 2 | 54.4 | 33.6 | 12.0 | 0.89 | 527 | 1198 | 11.2 | 539 | 958 | 23.5 | 28153 | ○ |
| 3 | 3 | 3 | 51.9 | 35.2 | 12.9 | 0.84 | 458 | 975 | 15.2 | 501 | 887 | 25.5 | 24863 | ○ |
| 4 | 4 | 4 | 67.6 | 15.7 | 16.7 | 0.92 | 694 | 1389 | 9.6 | 731 | 1306 | 21.5 | 29864 | ○ |
| 5 | 5 | 5 | 55.0 | 30.7 | 14.3 | 0.85 | 506 | 1234 | 10.2 | 599 | 1086 | 24.8 | 30603 | ○ |
| 6 | 6 | 6 | 55.8 | 28.9 | 15.3 | 0.89 | 538 | 1251 | 11.1 | 576 | 1063 | 25.2 | 31525 | ○ |
| 7 | 7 | 7 | 55.6 | 31.2 | 13.2 | 0.82 | 591 | 1232 | 12.1 | 601 | 1010 | 25.6 | 31539 | ○ |
| 8 | 8 | 8 | 56.1 | 32.2 | 11.7 | 0.79 | 605 | 1210 | 12.8 | 604 | 1029 | 24.5 | 29645 | ○ |
| 9 | 9 | 9 | 56.0 | 32.5 | 11.5 | 0.91 | 577 | 1247 | 10.6 | 605 | 1094 | 24.5 | 30552 | ○ |
| 10 | 10 | 10 | 53.5 | 33.8 | 12.7 | 0.80 | 522 | 1214 | 11.8 | 588 | 1068 | 23.6 | 28650 | ○ |
| 11 | 11 | 11 | 54.2 | 34.6 | 11.2 | 0.77 | 510 | 1237 | 10.7 | 612 | 1101 | 21.2 | 26224 | ○ |
| 12 | 12 | 12 | 49.2 | 37.6 | 13.2 | 0.82 | 468 | 1201 | 12.4 | 543 | 1021 | 24.5 | 29425 | ○ |
| 13 | 13 | 13 | 53.5 | 33.9 | 12.6 | 0.81 | 516 | 1199 | 13.6 | 546 | 1007 | 25.6 | 30694 | ○ |
| 14 | 14a | 14b | 40.5a | 56.3a | 3.2a | 0.90 | 345 | 879 | 17.8 | 332 | 642 | 23.4 | 20569a | X |
| 15 | 15a | 15 | 64.1 | 35.7 | 0.2a | 1.18a | 501 | 1043 | 9.2 | 512 | 845 | 15.5 | 16167a | X |
| 16 | 16a | 16 | 67.2 | 30.5 | 2.3a | 0.99 | 428 | 995 | 10.2 | 439 | 856 | 14.3 | 14229a | X |
| 17 | 17 | 17 | 54.1 | 34.5 | 11.4 | 0.82 | 531 | 1221 | 11.7 | 592 | 1071 | 23.5 | 28694 | ○ |

(a: out of the range specified in the present invention, b: out of recommended range, BF: bainitic ferrite, PF: polygonal ferrite, $\gamma_R$: retained austenite ○: room-temperature TS ≥ 840 MPa; and product of the room-temperature TS and the warm EL ≥ 24000 MPa. %, X: room-temperature TS < 840 MPa; or product of the room-temperature TS and the warm EL < 24000 MPa. %)

These results indicate as follows.

Initially, Steels Nos. 1 to 13 and 17 are all inventive steels which are obtained by warm working of steel sheets manufactured under recommended manufacture conditions using material steels having chemical compositions within ranges specified in the present invention and are high-strength steel sheets having good balance between the tensile strength at mom temperature and the elongation under warm conditions (product of room-temperature TS by warm EL).

In contrast, following comparative steels having chemical compositions not satisfying any of conditions specified in the present invention have following problems, respectively.

Steel No. 14 is a sample having a small carbon content, suffers from an excessively large amount of polygonal ferrite and an insufficient amount of γR, and thereby has a product of the room-temperature TS and the warm ET, not satisfying the acceptance criterion.

Steel No. 15 is a sample having a small total amount of Si and Al (Si+Al), suffers from, even though having a low strength, a low EL under warm conditions because of containing substantially no desired γR, and thereby has a product of the mom-temperature TS and the warm EL not satisfying the acceptance criterion.

No. 16 is a sample having a small Mn content, suffers from insufficient formation of γR, has an inferior elongation under warm conditions, and thereby has a product of the room-temperature TS and the warm EL not satisfying the acceptance criterion

Experimental Example 2

Analysis of Manufacture Conditions

In this experimental example, steel sheets were manufactured (hot-rolled steel sheets had a gage of 2.0 mm) under conditions given in Table 4 using the slab specimen of Material Steel No. 9, and how the working temperature affects the mechanical properties was examined by the procedure of Experimental Example 1, while varying the working temperature (tensile temperature) from 20° C. to 350° C. The material steel used herein is a steel having the chemical composition satisfying the conditions specified in the present invention.

Figure 2:
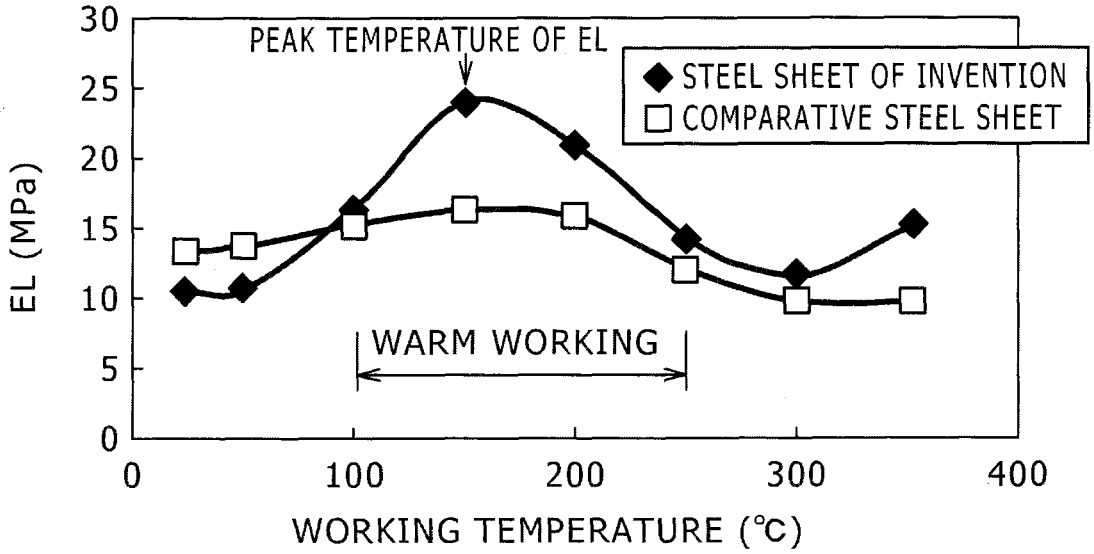
FIG. 2 is a graphical representation illustrating how the working temperature, when varied, affects the elongation (EL), in which a steel sheet of the present invention is compared with a comparative steel sheet.

The results are indicated in Table 5, and how TS and EL, respectively, vary depending on the working temperature is illustrated as graphs in FIGS. 1 and 2.

TABLE 4

| Manufacture No. | Soaking temperature (° C.) | Soaking time (s) | Cooling rate (° C.) | Supercooling temperature (° C.) | Supercooling holding time (s) | Reheating rate (° C./s) | Austempering temperature (° C.) | Austempering time (s) |
|---|---|---|---|---|---|---|---|---|
| 1 | 780 | 500 | 50 | 350 | 5 | 20 | 400 | 500 |
| 2 | 840 | 200 | 50 | 350 | 5 | 20 | 400 | 500 |
| 3 | 780 | 500 | 30 | 350 | 5 | 20 | 400 | 500 |
| 4 | 780 | 500 | 50 | 160 | 5 | 20 | 400 | 500 |
| 5 | 780 | 500 | 50 | 350 | 60 | 20 | 400 | 500 |
| 6 | 780 | 500 | 50 | 350 | 5 | 10 | 400 | 500 |
| 7 | 780 | 300 | 50 | 350 | 5 | 5 | 400 | 500 |
| 8 | 780 | 500 | 50 | 350 | 5 | 20 | 300 | 500 |
| 9 | 780 | 500 | 50 | 350 | 5 | 20 | 480 | 500 |
| 10 | 780 | 500 | 50 | 350 | 5 | 20 | 400 | 60 |
| 11 | 780 | 500 | 50 | 350 | 5 | 20 | 400 | 750 |
| 12 | 780 | 500 | 50 | 350 | 5 | 20 | 400 | 1000 |
| 13b | 780 | 500 | 50 | — b | — b | — b | 400 | 500 |

TABLE 4-continued

| Manufacture No. | Soaking temperature (° C.) | Soaking time (s) | Cooling rate (° C.) | Supercooling temperature (° C.) | Supercooling holding time (s) | Reheating rate (° C./s) | Austempering temperature (° C.) | Austempering time (s) |
|---|---|---|---|---|---|---|---|---|
| 14b | 740b | 500 | 50 | 350 | 5 | 20 | 400 | 500 |
| 15b | 880b | 500 | 50 | 350 | 5 | 20 | 400 | 500 |
| 16b | 780 | 800 | 50 | 130b | 5 | 20 | 400 | 500 |
| 17b | 780 | 800 | 50 | 350 | 90b | 20 | 400 | 500 |
| 18b | 780 | 500 | 50 | 350 | 5 | 1b | 400 | 500 |
| 19b | 780 | 500 | 50 | 350 | 5 | 20 | 275b | 500 |
| 20b | 780 | 500 | 50 | 350 | 5 | 20 | 500b | 500 |
| 21b | 780 | 500 | 50 | 350 | 5 | 20 | 400 | 30b |
| 22b | 780 | 500 | 50 | 350 | 5 | 20 | 400 | 1500b |

(b: out of recommended range)

TABLE 5

| Material | | | Structure | | | | Mechanical properties at room temperature | | | Mechanical properties at a temperature (150° C.-300° C.) where EL attains maximum | | | Product of room-temperature TS | |
|---|---|---|---|---|---|---|---|---|---|---|---|---|---|---|
| Steel No. | Steel No. | Manufacture No. | M + BF (%) | PF (%) | $\gamma_R$ (%) | $C\gamma_R$ (mass %) | YS (MPa) | TS (MPa) | EL (%) | YS (MPa) | TS (MPa) | EL (%) | and warm EL (MPa. %) | Judgment |
| 1 | 9 | 1 | 56.0 | 32.5 | 11.5 | 0.91 | 577 | 1247 | 10.6 | 605 | 1094 | 24.5 | 30552 | ○ |
| 2 | 9 | 2 | 79.3 | 7.0 | 13.7 | 0.90 | 723 | 1357 | 9.9 | 756 | 1190 | 22.2 | 30125 | ○ |
| 3 | 9 | 3 | 49.8 | 38.1 | 12.1 | 0.89 | 666 | 1098 | 12.2 | 701 | 965 | 25.4 | 27889 | ○ |
| 4 | 9 | 4 | 60.1 | 33.4 | 6.5 | 0.82 | 602 | 1295 | 11.5 | 629 | 1140 | 21.6 | 27972 | ○ |
| 5 | 9 | 5 | 62.6 | 31.5 | 5.9 | 0.99 | 589 | 1274 | 12.5 | 621 | 1120 | 20.9 | 26627 | ○ |
| 6 | 9 | 6 | 55.1 | 32.5 | 12.4 | 0.93 | 621 | 1260 | 13.1 | 665 | 1110 | 23.2 | 29232 | ○ |
| 7 | 9 | 7 | 52.7 | 33.1 | 14.2 | 0.91 | 578 | 1241 | 13.6 | 603 | 1098 | 24.3 | 30156 | ○ |
| 8 | 9 | 8 | 62.6 | 31.5 | 5.9 | 0.96 | 603 | 1301 | 8.9 | 542 | 1152 | 20.9 | 27191 | ○ |
| 9 | 9 | 9 | 51.0 | 32.2 | 16.8 | 0.75 | 466 | 1011 | 15.8 | 499 | 880 | 26.2 | 26488 | ○ |
| 10 | 9 | 10 | 57.3 | 31.9 | 10.8 | 0.69 | 697 | 1322 | 10.9 | 743 | 1174 | 19.3 | 25515 | ○ |
| 11 | 9 | 11 | 49.0 | 33.0 | 18.0 | 0.95 | 675 | 1298 | 12.4 | 721 | 1150 | 22.5 | 29205 | ○ |
| 12 | 9 | 12 | 52.8 | 32.5 | 14.7 | 0.98 | 674 | 1225 | 13.1 | 710 | 1091 | 22.9 | 28053 | ○ |
| 13 | 9 | 13b | 59.2 | 30.3 | 10.5 | 1.21a | 591 | 1234 | 13.5 | 593 | 1084 | 16.8 | 20731a | X |
| 14 | 9 | 14b | 47.7 | 45.6a | 6.7 | 0.93 | 401 | 878 | 17.3 | 432 | 760 | 26.5 | 23267a | X |
| 15 | 9 | 15b | 85.5 | 3.9a | 10.6 | 0.89 | 641 | 1377 | 8.7 | 682 | 1210 | 16.7 | 22996a | X |
| 16 | 9 | 16b | 69.4 | 30.3 | 0.3a | 0.67 | 610 | 1254 | 11.5 | 641 | 1105 | 12.7 | 15926a | X |
| 17 | 9 | 17b | 63.6 | 32.5 | 3.9a | 0.93 | 632 | 1283 | 12.1 | 675 | 1134 | 15.1 | 19373a | X |
| 18 | 9 | 18b | 66.1 | 29.5 | 4.4a | 0.88 | 641 | 1298 | 12.5 | 678 | 1141 | 18.2 | 23624a | X |
| 19 | 9 | 19b | 63.2 | 31.1 | 5.7 | 1.22a | 651 | 1403 | 7.6 | 692 | 1254 | 10.9 | 15293a | X |
| 20 | 9 | 20b | 58.0 | 32.2 | 9.8 | 0.51a | 415 | 889 | 16.9 | 540 | 789 | 18.7 | 16624a | X |
| 21 | 9 | 21b | 65.6 | 30.2 | 4.2a | 0.89 | 587 | 1284 | 7.9 | 614 | 1131 | 12.2 | 15665a | X |
| 22 | 9 | 22b | 64.3 | 31.8 | 3.9a | 0.88 | 554 | 1179 | 11.8 | 591 | 1041 | 14.5 | 17096a | X |

(a: out of the range specified in the present invention, b: out of recommended range, BF: bainitic ferrite, PF: polygonal ferrite, $\gamma_R$: retained austenite ○: room-temperature TS ≥ 840 MPa; and product of the room-temperature TS and the warm EL ≥ 24000 MPa. %, X: room-temperature TS < 840 MPa; or product of the room-temperature TS and the warm EL < 24000 MPa. %)

These results indicate as follows.

Steels Nos. 1 to 12 are all inventive steels which are obtained by warm working of steel sheets manufactured under recommended manufacture conditions using material steels having chemical compositions within ranges specified in the present invention and are high-strength steel sheets having good balance between the tensile strength at room temperature and the elongation under warm conditions (product of the room-temperature TS and the warm EL).

In contrast, the following comparative steels having structures not satisfying any of the conditions specified in the present invention have the following problems, respectively.

Steel No. 13 is prepared by performing austempering immediately after soaking without supercooling and subsequent reheating, is a sample corresponding substantially to the steel of the prior art, except for undergoing soaking in a different temperature range, has a $C_{\gamma R}$ of 1 percent by mass or more, and thereby has a product of the mom-temperature TS and the warm EL not satisfying the acceptance criterion.

Steel No. 14 is a sample undergone soaking at a temperature lower than the (γ+α) dual-phase region, includes polygonal ferrite in an excessively large area percentage, and thereby has a mom-temperature TS and a product of the mom-temperature TS and the warm EL neither satisfying the acceptance criteria.

Steel No. 15 is a sample undergone soaking at a temperature in the austenite single-phase region higher than the (γ+α) dual-phase region and is a sample corresponding substantially to the steel of the prior invention, except for undergoing, after soaking, supercooling and subsequent reheating. This steel includes bainitic ferrite in an insufficient area percentage and thereby has a room-temperature TS and a product of the mom-temperature TS and the warm EL neither satisfying the acceptance criteria.

Steel No. 16 is a sample undergone supercooling at an excessively low temperature and includes γR in an insufficient area percentage. This sample thereby has a low elongation under warm conditions and has a product of the room-temperature TS and the warm EL not satisfying the acceptance criterion.

Steel No. 17 is a sample undergone supercooling performed for an excessively long holding time and includes γR in an insufficient area percentage due to decomposition of γR into carbides. This sample thereby has a low elongation under warm conditions and has a product of the room-temperature TS and the warm EL not satisfying the acceptance criterion.

Steel No. 18 is a sample undergone reheating performed at an excessively low reheating rate and includes γR in an insufficient area percentage due to decomposition of γR into carbides. This sample thereby has a low elongation under warm conditions and has a product of the mom-temperature TS and the warm EL not satisfying the acceptance criterion.

Steel No. 19 is a sample undergone austempering performed at an excessively low temperature, thereby has an excessively high $C_{\gamma R}$, and has a product of the mom-temperature TS and the warm EL not satisfying the acceptance criterion Steel No. 20 is a sample undergone austempering performed at an excessively high temperature, thereby has an insufficient $C_{\gamma R}$, and has a product of the room-temperature TS and the warm EL not satisfying the acceptance criterion Steels Nos. 21 and 22 are samples undergone austempering for a time out of the recommended range, include γR in an insufficient area percentage, and thereby have a product of the mom-temperature TS and the warm EL not satisfying the acceptance criterion.

As is illustrated in FIG. 1 and FIG. 2, a comparison between Steel No. 1 in Table 5 as a steel sheet of the present invention and Steel No. 13 in Table 5 as a comparative steel sheet demonstrates that the steel sheet of the present invention has an FT, distinctly significantly higher than that of the comparative steel sheet, even though the both steel sheets have increasing effects on FT, in the warm working temperature range but have slightly lowered TS.

Specifically, the results demonstrate that the present invention may provide, through warm working, high-strength steel sheets which extremely excel in elongation properties although slightly sacrificing the strength.

While the present invention has been described in detail with reference to the specific embodiments thereof, it is obvious to those skilled in the art that various changes and modifications can be made in the invention without departing from the spirit and scope of the invention.

The present application is based on Japanese Patent Application No. 2010-068477 filed on Mar. 24, 2010 and Japanese Patent Application No. 2011-021596 filed on Feb. 3, 2011, the entire contents of which are incorporated herein by reference.

INDUSTRIAL APPLICABILITY

High-strength steel sheets according to the present invention are useful as steel sheets to be stamped and to be used typically in automobiles and industrial machines.

The invention claimed is:

1. A steel sheet, wherein the steel sheet has a chemical composition, on the percent by mass basis (hereinafter the same is applied to contents in the chemical composition), comprising:

carbon (C) in a content of from 0.05% to 0.4%;

silicon (Si) and aluminum (Al), wherein a total content of Si and Al, [Si+Al] is from 0.5% to 3%;

manganese (Mn) in a content of from 0.5% to 3%;

phosphorus (P) in a content of 0.15% or less (excluding 0%);

sulfur (S) in a content of 0.02% or less (including 0%); and iron and impurities, wherein the steel sheet has a tensile strength of 879 MPa or more and a structure comprising:

at least one of martensite and bainitic ferrite in a total amount of 45 to 80 percent by area relative to a total structure of the steel sheet;

polygonal ferrite in an amount of 15.7 to 40 percent by area relative to the total structure;

retained austenite in an amount of 5 to 20 percent by area relative to the total structure, wherein a carbon concentration ($C_{\gamma R}$) in the retained austenite is in a range of 0.6 percent by mass or more and less than 1.0 percent by mass; and optionally bainite in the range of 5% by area or less.

2. The steel sheet according to claim 1, wherein the chemical composition further comprises at least one element selected from the group consisting of:

molybdenum (Mo) in a content of 1% or less (excluding 0%), nickel (Ni) in a content of 0.5% or less (excluding 0%), copper (Cu) in a content of 0.5% or less (excluding 0%), and chromium (Cr) in a content of 1% or less (excluding 0%).

3. The steel sheet according to claim 1, wherein the chemical composition further comprises at least one element selected from the group consisting of:

titanium (Ti) in a content of 0.1% or less (excluding 0%), niobium (Nb) in a content of 0.1% or less (excluding 0%), vanadium (V) in a content of 0.1% or less (excluding 0%), and zirconium (Zr) in a content of 0.1% or less (excluding 0%).

4. The steel sheet according to claim 1, wherein the chemical composition further comprises:

at least one of calcium (Ca) in a content of 0.003% or less (excluding 0%) and a rare-earth element (REM) in a content of 0.003% or less (excluding 0%).

5. The steel sheet according to claim 2, wherein the chemical composition further comprises at least one element selected from the group consisting of:

titanium (Ti) in a content of 0.1% or less (excluding 0%), niobium (Nb) in a content of 0.1% or less (excluding 0%), vanadium (V) in a content of 0.1% or less (excluding 0%), and zirconium (Zr) in a content of 0.1% or less (excluding 0%).

6. The steel sheet according to claim 2, wherein the chemical composition further comprises: at least one of calcium (Ca) in a content of 0.003% or less (excluding 0%) and a rare-earth element (REM) in a content of 0.003% or less (excluding 0%).

7. The steel sheet according to claim 1, wherein the steel sheet has a strength flangeability (λ) of from 10 to 20%.

8. The steel sheet according to claim 1, wherein the steel sheet has a tensile strength of 879 MPa or more and 1357 MPa or less.

9. The steel sheet according to claim 1, wherein the structure of the steel sheet comprises retained austenite in an amount of 10 to 20 percent by area relative to the total structure.

10. The steel sheet according to claim 1, wherein the structure of the steel sheet comprises bainite in an amount of 3 percent or less by area relative to the total structure.

11. The steel sheet according to claim 1, where the structure of the steel consists of:

at least one of martensite and bainitic ferrite in a total amount of 45 to 80 percent by area relative to a total structure of the steel sheet;

polygonal ferrite in an amount of 15.7 to 40 percent by area relative to the total structure; and retained austenite in an amount of 5 to 20 percent by area relative to the total structure, wherein a carbon concentration ($C_{\gamma R}$) in the retained austenite is in a range of 0.6 percent by mass or more and less than 1.0 percent by mass.

12. The steel sheet according to claim 3, wherein the chemical composition further comprises: at least one of calcium (Ca) in a content of 0.003% or less (excluding 0%) and a rare-earth element (REM) in a content of 0.003% or less (excluding 0%).

13. The steel sheet according to claim 1, where the steel sheet has structure comprising:

wherein the steel sheet has a structure comprising:

at least one of martensite and bainitic ferrite in a total amount of 45 to 80 percent by area relative to a total structure of the steel sheet;

polygonal ferrite in an amount of 20 to 40 percent by area relative to the total structure;

retained austenite in an amount of 5 to 20 percent by area relative to the total structure, wherein a carbon concentration ($C_{\gamma R}$) in the retained austenite is in a range of 0.6 percent by mass or more and less than 1.0 percent by mass; and optionally bainite in the range of 5% by area or less.

14. The steel sheet according to claim 1, where the steel sheet has structure comprising:

wherein the steel sheet has a structure comprising:

at least one of martensite and bainitic ferrite in a total amount of 50 to 80 percent by area relative to a total structure of the steel sheet;

polygonal ferrite in an amount of 20 to 40 percent by area relative to the total structure;

retained austenite in an amount of 10 to 20 percent by area relative to the total structure, wherein a carbon concentration ($C_{\gamma R}$) in the retained austenite is in a range of 0.6 percent by mass or more and less than 1.0 percent by mass; and optionally bainite in the range of 5% by area or less.

15. The steel sheet according to claim 1, where the steel sheet has structure comprising:

wherein the steel sheet has a structure comprising:

at least one of martensite and bainitic ferrite in a total amount of 53 to 60 percent by area relative to a total structure of the steel sheet;

polygonal ferrite in an amount of 20 to 40 percent by area relative to the total structure;

retained austenite in an amount of 15 to 20 percent by area relative to the total structure, wherein a carbon concentration ($C_{\gamma R}$) in the retained austenite is in a range of 0.7 percent by mass or more and 0.9 percent by mass or less; and optionally bainite in a range of 3% by area or less.

* * * * *